US009477142B1

(12) United States Patent
Baumgartner

(10) Patent No.: US 9,477,142 B1
(45) Date of Patent: Oct. 25, 2016

(54) MODULAR PHOTOGRAPHY BACKDROP SYSTEM

(71) Applicant: Everest Media, Inc., Itasca, IL (US)

(72) Inventor: Dennis Baumgartner, Bartlett, IL (US)

(73) Assignee: Everest Media, Inc., Itasca, IL (US)

( * ) Notice: Subject to any disclaimer, the term of this patent is extended or adjusted under 35 U.S.C. 154(b) by 0 days.

(21) Appl. No.: 14/826,500

(22) Filed: Aug. 14, 2015

(51) Int. Cl.
*G03B 15/10* (2006.01)
*A63J 1/02* (2006.01)

(52) U.S. Cl.
CPC . *G03B 15/10* (2013.01); *A63J 1/02* (2013.01)

(58) Field of Classification Search
None
See application file for complete search history.

(56) References Cited

U.S. PATENT DOCUMENTS 2,052,178 A * 8/1936 Holden ..... A63J 1/02 472/77
2,169,274 A * 8/1939 Mills ..... E04B 2/821 52/126.4
3,180,459 A * 4/1965 Liskey, Jr. ..... E04B 2/7437 403/327
3,466,777 A * 9/1969 Wistrand ..... A47F 11/02 40/605
3,571,999 A * 3/1971 Downing ..... A47F 11/02 160/135
3,605,851 A * 9/1971 Miles ..... E04B 2/74 160/135
3,733,756 A * 5/1973 Butler ..... E04B 2/7401 52/284
3,768,222 A * 10/1973 Birum, Jr. ..... E04B 2/7427 160/135
3,869,992 A * 3/1975 Kramer ..... A47B 41/00 108/158.11
3,889,736 A * 6/1975 Firks ..... A47G 5/00 16/225
4,022,461 A 5/1977 Harris
4,204,375 A * 5/1980 Good ..... E04B 2/7425 403/262
RE30,777 E * 10/1981 Ytter ..... A47G 5/00 160/135
4,375,829 A * 3/1983 Dorr ..... A47G 5/00 160/135
4,436,135 A * 3/1984 Ytter ..... G09F 15/0068 160/135
4,635,417 A * 1/1987 Larouche ..... E04B 2/7405 160/135
4,865,111 A * 9/1989 Perutz ..... A47F 5/105 160/135
4,951,076 A 8/1990 Baillie-Hamilton et al.
4,958,671 A * 9/1990 Bove ..... A47G 5/00 160/135
5,130,794 A * 7/1992 Ritchey ..... F41G 7/30 348/383
5,235,789 A * 8/1993 Rackowski ..... G09F 15/0068 52/238.1
5,352,149 A * 10/1994 Melashenko ..... A47G 5/00 160/135

(Continued)

*Primary Examiner* — Rodney Mintz
(74) *Attorney, Agent, or Firm* — Womble Carlyle Sandridge & Rice, LLP

(57) ABSTRACT

A modular backdrop system and related methods of assembly and use for photography are described herein. The system includes a modular wall formed from a fixed frame and a plurality of removably attachable modules where: at least one module has a first height H1 and a first width W1, at least one module has a second height H2, different from the first height H1, and a second width W2 approximately equal to the first width W1, at least one module has a third height H3 approximately equal to the sum of H1 plus H2 and a third width W3 different from the second width H2, and at least one module has the first height H1 and the third width W3.

25 Claims, 4 Drawing Sheets

(56) References Cited

U.S. PATENT DOCUMENTS 5,494,178 A * 2/1996 Maharg ..... A47F 5/0815 211/182
5,592,787 A * 1/1997 Ophardt ..... E04H 1/1266 52/239
5,603,370 A * 2/1997 Boer ..... G09F 15/0068 160/135
5,881,789 A * 3/1999 Melashenko ..... A47D 13/063 160/135
6,012,258 A 1/2000 Brown et al.
6,155,014 A * 12/2000 Wagner ..... E04B 2/7453 52/239
7,743,781 B2 * 6/2010 Slaughter ..... E04H 15/001 135/117
8,082,971 B1 * 12/2011 Peterson ..... A47G 5/00 160/135
8,123,526 B2 * 2/2012 Hoover ..... F41G 3/2627 434/11
8,756,867 B2 * 6/2014 Maxam ..... A63J 1/02 446/111
9,220,995 B2 * 12/2015 Maxam ..... A63J 1/02 52/7
2003/0221798 A1 * 12/2003 Hunt ..... E04B 2/7431 160/135
2006/0160467 A1 7/2006 Brock et al.
2007/0054595 A1 * 3/2007 Pinto ..... G09F 19/00 446/482
2007/0273757 A1 * 11/2007 Mader ..... G03B 37/04 348/36
2010/0064596 A1 * 3/2010 Bowsher ..... G06T 15/00 52/29
2010/0132895 A1 * 6/2010 Logue ..... A47B 46/005 160/127
2010/0307080 A1 * 12/2010 Parshad ..... E04B 2/7425 52/220.7
2011/0168653 A1 * 7/2011 Garrett ..... H04N 5/64 211/59.4
2012/0006498 A1 * 1/2012 Potter ..... A01K 1/035 160/127
2012/0168097 A1 * 7/2012 Gilbert ..... A47G 5/00 160/130
2014/0069025 A1 * 3/2014 Maxam ..... A63J 1/02 52/6
2014/0138035 A1 * 5/2014 Potter ..... E04B 2/7427 160/135
2014/0197123 A1 * 7/2014 McPhillips ..... G09F 15/00 211/195
2014/0263138 A1 * 9/2014 Koch ..... A47B 47/0075 211/195
2014/0283459 A1 * 9/2014 Maxam ..... A63J 1/02 52/7

* cited by examiner

MODULAR PHOTOGRAPHY BACKDROP SYSTEM

FIELD OF DISCLOSURE

The present disclosure relates to the field of photography. More particularly, the present disclosure relates to a set, scene, or backdrop constructed from modular elements.

BACKGROUND

Photographers who work in a studio environment often have backdrops or scenery for use behind the subject of their photographs. In some cases, solid color or printed scenes are provided on pliable or flexible sheets that can be draped or otherwise supported behind the subject. While these scenes can be readily switched in and out, often by folding one scene behind another, these sheet-type backgrounds can negatively impact the life-like quality of the completed images.

In some cases, where particular settings will be used regularly, a photographer may build a more life-like background, such as a non-loadbearing wall. In each of these cases, the backdrop is custom made, and changing from one background to another requires constructing separate backgrounds and either physically moving a large constructed set, or moving the location being captured by the camera.

Therefore, there remains a need for a background or backdrop that can be used in photography or related studio/theatre settings that combine the interchangeability of scenery sheets with the more life-like appearance of physically created walls and barriers.

SUMMARY

One embodiment of the present disclosure includes a modular backdrop system. The system may comprise at least one modular wall. The modular wall may comprise a fixed frame providing upright wall portions and a header portion spanning between the upright wall portions, and a plurality of removably attached modules that, when combined, fill in the frame of the modular wall between the upright portions and from the header portion to a floor. When one or more of the plurality of modules is omitted from within the frame, an opening is provided through the modular wall that is sized and positioned to correspond with at least one of a full-sized doorway, a window, or a threshold through the backdrop system. The plurality of removably attached modules may include four difference sizes such that at least one first module has a first height H1 and a first width W1, at least one second module has a second height H2, different from the first height H1, and a second width W2 approximately equal to the first width W1, at least one third module having a third height H3 approximately equal to the sum of H1 plus H2, and a third width W3 different from the second width H2, and at least one fourth module having the first height H1 and the third width W3.

The present disclosure also includes a modular backdrop system of at least one wall. The wall may comprise a first, solid appearance provided by a set of removably attached modules, and a second appearance provided by omitting at least one of the removable modules from the combined set of modules. The second appearance comprises at least one of a full-sized doorway, a full-size window, or a full-size threshold through the wall.

Other embodiments include a method of creating a backdrop. The method may include assembling at least one modular wall by removably attaching a plurality of modules to a fixed frame and one another. The modules may comprise: at least one first module having a first height H1 and a first width W1; at least one second module having a second height H2, different from the first height H1, and the at least one second module having a second width W2 approximately equal to the first width W1; at least one third module having a third height H3 approximately equal to the sum of H1 plus H2, and a third width W3 different from the second width H2; and at least one fourth module having the first height H1 and the third width W3. The method may also include adding at least one of a door frame and a window frame.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

As used herein, the term "height" is used with respect to a generally vertical dimension along a floor to ceiling direction. The term "width" is used with respect to a generally horizontal dimension along the plane of the backdrop system perpendicular to the height direction. To the extent necessary, the term "thickness" is used to describe the dimension along a direction into and out of the backdrop system perpendicular to each of the height and width directions.

As used herein, the term "about" can allow for manufacturing tolerances resulting from the use of inexact tools, such as handsaws, that may be used to construct one or more elements of the backdrop system. The term "about" may also allow for intentional margins known in the building products industry (e.g. a standard "2×4" piece of finished lumber is not 2 inches by 4 inches by instead 1.5" by 3.5"). The term "about" may also allow for intentional margins incorporated into the design of each module to provide tolerance so the modules can be arranged within a confined space without unnecessarily precise construction. For example each dimension of each module may be intentionally created 1/16", 1/8", 3/16", 1/4", 5/16" etc. up to one-inch shorter than the dimensions provided in the examples to allow for the preferred margin of error when all of the modules are fit together. When all the modules are fit together, shams may be added if necessary to create a sufficiently tight fit. In some cases, however, a sham is not necessary and gaps are acceptable because the backdrop may be covered on a visible side by fabric, paper or other sheet-like covering to hide the gaps and seams between modules.

Figure 1:
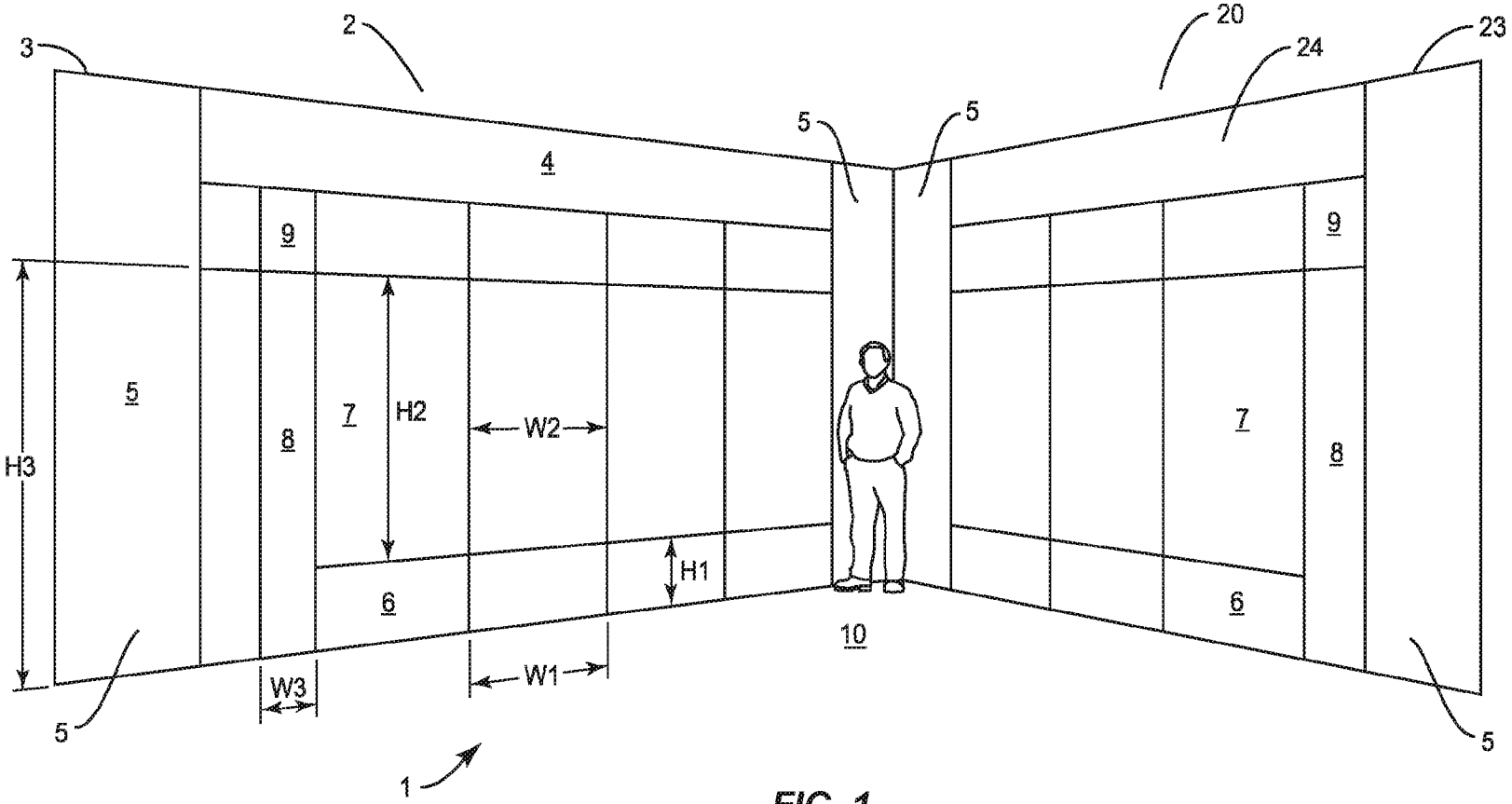
FIG. 1 shows a backdrop system of the present disclosure in a first configuration.

FIG. 1 shows a backdrop system 1 according to an embodiment of the present disclosure. The backdrop system 1 includes at least one modular wall 2. The illustrated backdrop system 1 includes a first modular wall 2 and a second modular wall 20. When used as a background representative of a living space, the first modular wall 2 and the second modular wall 20 may be arranged at right angles relative to one another to represent a corner of a room.

Each modular wall 2, 20 may have an outer frame 3, 23. The outer frame 3, 23 may comprise a header 4, 24 and a pair of side panels 5. The width of the header 4, 24 may vary depending on the total width of each wall 2, 20. Therefore, the first wall 2 has a first header 4 and the second wall 20 has a second header 24 because the walls 2, 20 are illustrated in FIG. 1 as having different widths. The width of each side panel 5 may vary as well, but each may be preferably about two feet wide. Each outer frame 3, 23 may be substantially fixed. In other words, the headers 4, 24 may not be intended to be removed from the respective side panels 5. The headers 4, 24 may be attached to the side panels 5 using fasteners that would be disassembled less quickly than fasteners used to combine other elements that are described as "removably attached." For example, the frames 3, 23 may be assembled with nails, screws, or nuts and bolts.

FIG. 1 shows each wall 2, 20 in a complete or solid configuration. In the solid, complete, or continuous configuration, the frame 3, 23 is substantially completely filled to produce the appearance of a substantially continuous wall. Several removably attachable modules 6-9, i.e. wall sections, may be assembled together to completely fill the frame 3, 23 and produce the substantially continuous wall configuration. The removably attachable modules 6-9 may include one or more first modules 6 having a first width W1 that approximates the width of a full-size door opening, such as about 36 inches wide. Each first module 6 may have a first height H1 convenient for use as a spacer, and representing a common margin between the floor 10 and a window. When combined with the height of a header 4, 24, the first height H1 of the first module 6 may represent a common gap between the top of a doorway and a ceiling or the distance between a ceiling and a curtain rod over a window. In one example, H1 is about 18 inches.

The plurality of removably attached modules 6-9 may include one or more second modules 7 that may have a second width W2, which in some embodiments is equal to the first width W1. Again, W1 may closely approximate a widthwise opening of a full size doorway. The second module 7 may have a second height H2 different from the first height H1. The second height H2 may be determined such that the combined magnitude of the first height H1 and the second height H2 closely approximates the height of a commonly used doorway, for example an 82-inch tall doorway. Therefore, if H1 is about 18 inches, and H1+H2 is 82 inches, H2 may be about 64 inches.

The plurality of removably attached modules 6-9 may include one or more third modules 8 that may have a third height H3 that approximates the height of a standard doorway. The third height H3 can be understood to approximate the combined magnitude of the first height H1 and the second height H2. Thus, as seen in FIG. 1, the third module 8 is convenient for being arranged adjacent to a first module 6 with a second module 7 stacked on top of the first module 6.

The third modules 8 may have a third width W3. In one embodiment the third width W3 is about 12 inches or 1/3 of the first width W1. Therefore, the modules 6-9 can be used to fill widths in increments of one-foot. In other words, omitting certain modules 6-9 can leave openings through the wall 2 that may be three feet wide but can also be enlarged one foot at a time to cover a variety of widths of possible doorways, windows or passageways.

The plurality of removably attached modules 6-9 may further comprise one or more fourth modules 9. To provide the complete wall configurations of FIG. 1 within the rectangular openings defined by the frames 3, 23, the fourth modules 9 may have a height substantially equal to the first height H1 of the first modules 6. The fourth modules 9 may have a width substantially equal to the third width W3 of the third modules 8.

FIG. 1 shows a first embodiment of removably attachable modules 6-9 creating a full wall configuration for the first wall 2. The first embodiment of modules includes eight first modules 6, four second modules 7, two third modules 8, and two fourth modules 9. The arrangement of the first embodiment of modules as show in FIG. 1 may be described as having the four second modules 7 arranged side-by-side between the side panels 5. Each of the second modules 7 is sandwiched vertically between two first modules 6. The two third modules 8 extend upward from the floor. The two third modules are positioned side-by-side one another and adjacent to one of the second modules 7. Each fourth module 9 is provided atop a respective third module 8.

FIG. 1 shows a second embodiment of removably attachable modules 6-9 creating a full wall configuration for the second wall 20. The second wall 20 is narrower, i.e. smaller along the width direction, than the first wall 2. Therefore the second embodiment of modules 6-9 is different from the first embodiment. The second embodiment may include six first modules 6, three second modules 7, a single third module 8, and a single fourth module 9. Similar to their use within the first wall 2, the three second modules 7 may be arranged side-by-side, each sandwiched vertically between first modules 6. The third module 8 may extend upward from the floor and be positioned adjacent to one of the second modules 7. The fourth module 9 may be provided above the third module 8.

Figure 2:
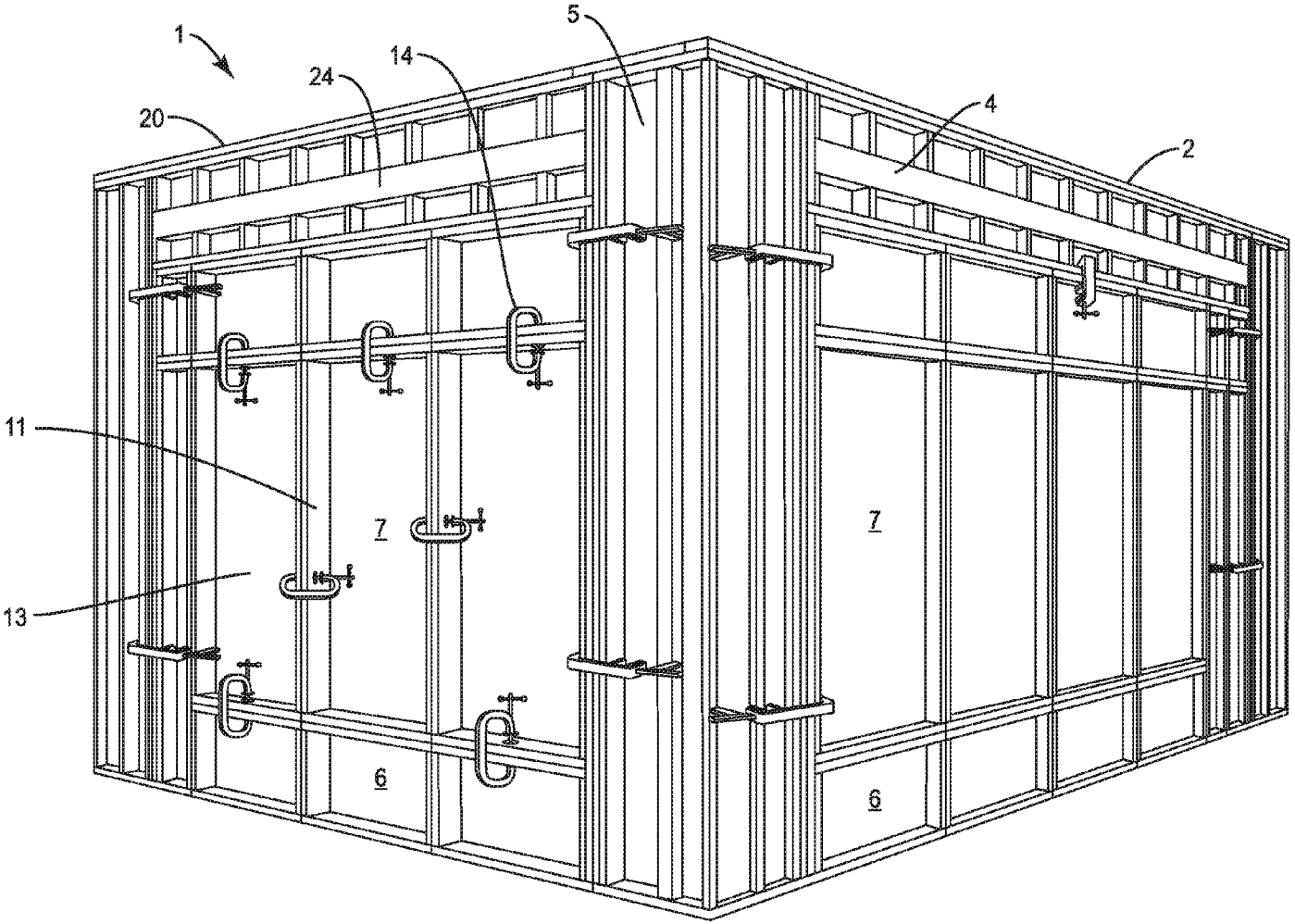
FIG. 2 shows a rear view of the backdrop system of FIG. 1 to illustrate an embodiment of the attachment of the modules.

FIG. 2 shows a rear view of the backdrop system 1. From this rear view, the construction of the removably attachment modules 6-9 becomes visible. Each module 6-9 may include a peripheral frame 11. In one example the peripheral frame 11 of each module 6-9 may be constructed from wood, such as 2×4's. A front wall 13 of each module 6-9 may be provided by plywood, particle board, sheet rock, or other planar material that can be readily cut to the appropriate size and joined to the peripheral frame 11 of each module 6-9.

In the embodiment shown, the modules 6-9 may be removably attached to one another by fasteners 14 combining adjacent modules 6-9 by securing together adjacent respective portions of the peripheral frame 11 of each module 6-9. Fasteners 14 should be considered to provide a sufficiently secure connection for the backdrop system 1 while being more quickly releasable than the bolts or other elements that may be used to create the frames 3, 23. In a preferred embodiment, a quick-release C-clamp fastener or a quick release F-clamp fastener may be used as a fastener 14 to secure together adjacent modules 6-9. In the illustrated embodiments, F-clamps and C-clamps are separate from the modules 6-9 themselves. In other words, the fasteners 14 have been integrated into the modules 6-9. The peripheral frame 11 of each module 6-9 may be free from features used to attach on module to an adjacent module. This may simplify the construction of each module.

Figure 3:
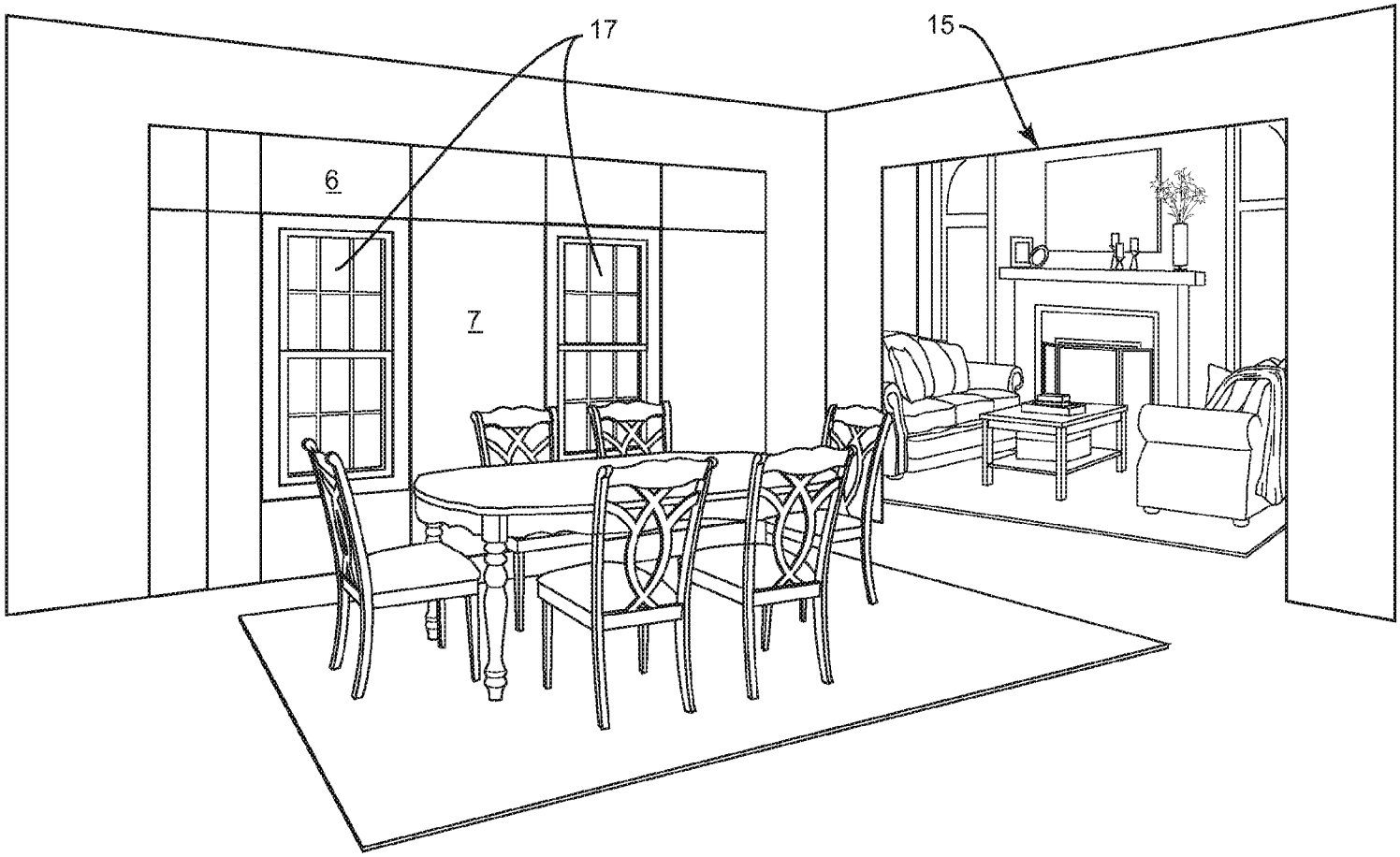
FIG. 3 shows the backdrop system of FIG. 1 in a second configuration.

While FIG. 1 shows the first and second walls 2, 20 in a full configuration, FIG. 3, on the other hand, shows the first wall 2 with a pair of windows and the second wall 20 in a passageway configuration without any modules 6-9 installed. As shown, window frames 17 may be used in place of first modules 6. The window frame 17 also allows for non-rectangular windows, such as the arc-topped window shown in FIG. 4. In the configuration of the second wall 20 shown in FIG. 3, all of the modules 6-9 have been removed leaving merely a passageway 15 through the second wall 20.

When in-use, the front of each wall 2, 20 may be covered, such as by rolls of paper, to provide the appearance of a painted wall and hide any gaps occurring between adjacent modules 6-9. Other embellishments may be added to the active side of each wall 2, 20, such as crown molding, floor molding, chair rails, etc. to further enhance the appearance of each wall 2, 20.

Figure 4:
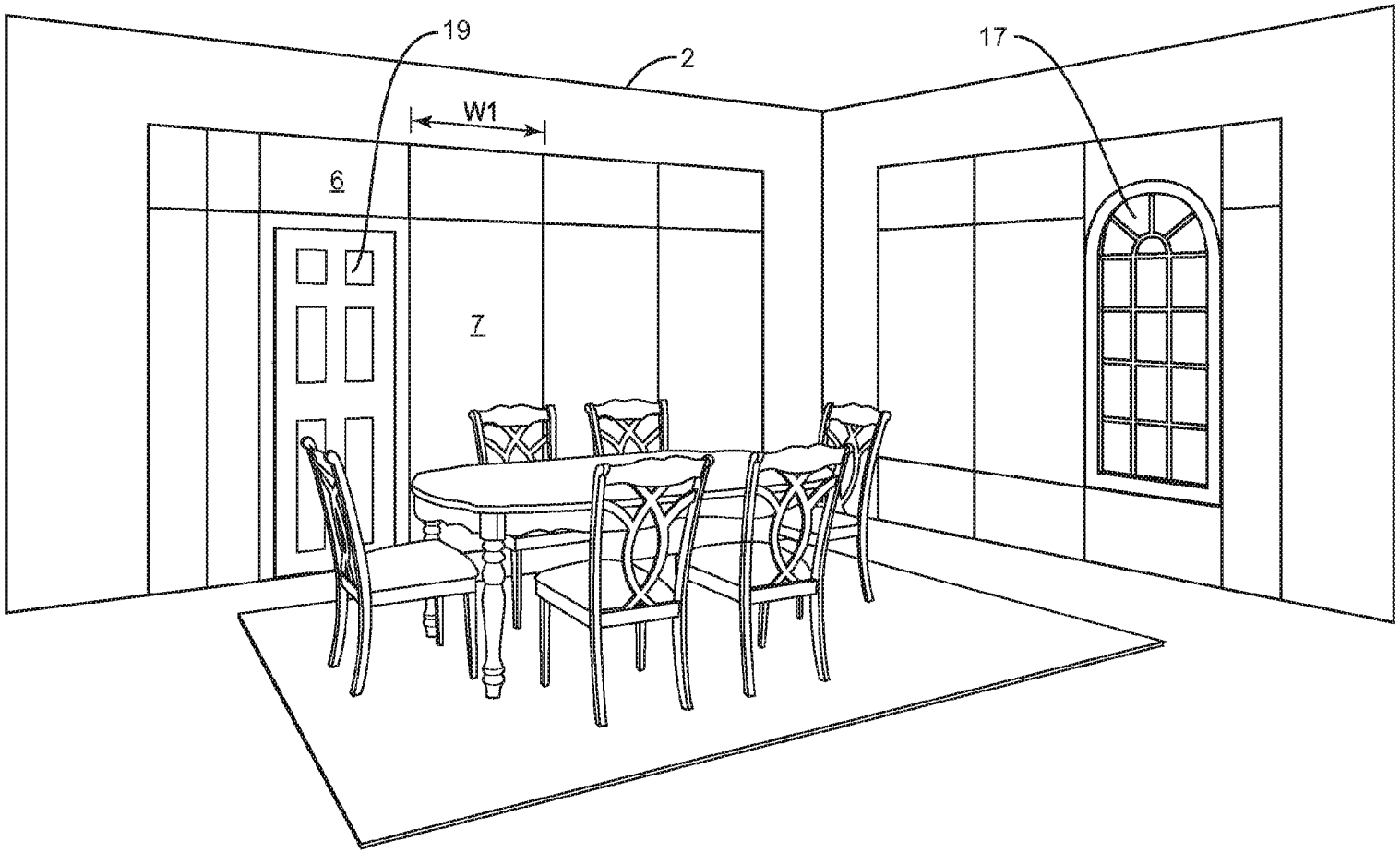
FIG. 4 shows the backdrop system of FIG. 1 in a third configuration.

FIG. 4 shows yet another configuration of the wall 2, with a doorway 19 provided by the removal of one of the first modules 6 that is adjacent to the floor and a corresponding second module 7 that would have been disposed directly above the selectively removed first module 6. As previously stated, the first and second modules 6, 7 have a first width W1 that was predetermined to correspond with the width of a standard doorway.

The backdrop system 1 provides many advantages to photographers. Particularly, the backdrop system 1 has been designed with specifically sized and arranged modules 6-9 to provide an imitation wall, preferably imitating a wall within a residential setting, such as a bedroom or a living room. The disclosed backdrop system 1 allows for the owner to quickly and easily convert the modular wall 2 to one of several configurations common to residential environments, including the presence of one or more doors, one or more windows, or merely a passageway present between rooms. The backdrop system 1 provides a single system that is both reconfigurable and reusable so that the set designer does not have to create new scenes for each production.

In one example the backdrop system 1 described in this disclosure may be used to produce a reconfigurable scene in which to photograph home furnishings. The backdrop system 1 may improve upon the system and methods described in U.S. patent application Ser. No. 14/531,396 filed Nov. 3, 2014, which is incorporated herein by reference. Use of the backdrop system 1 with its removably interchangeable modules may allow for the display method to be improved by allowing the consumer to select a backdrop or wall configuration most similar to their individual home because the first and second modular walls 2, 22 of the present disclosure have been photographed in several alternative configurations of windows and doors.

The backdrop system 1 of the present disclosure may be described in terms of a method of creating a backdrop. The method may include assembling the first wall 2 in a full configuration, then removing at least one module from the fully assembled wall. Some embodiments of the method may also include adding at least one of a door frame and a window frame in place of the removed at least one module. Further, the method may include covering a face of the modular wall to mask the modular wall during use as a backdrop.

Use of the backdrop system described herein may result in a novel method of photography, comprising: assembling at least one modular wall 2, 22 as described herein. The photography method may also include, removing at least one module from the assembled wall. The method may optionally include adding at least one of a door frame and a window frame in place of the removed at least one module. The method can include the step of covering a face of the modular wall with a scene to be photographed. The method can conclude with taking a photograph that includes the covered face of the modular wall. In view of U.S. patent application Ser. No. 14/531,396, the method of photography can including taking several photographs of the modular wall 2 in several configurations of the wall 2 without having or desiring to adjust the location or settings of the camera, and without adjusting the lighting of the environment in which the wall 2 is being used.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A modular backdrop system, comprising:

at least one modular wall, the at least one modular wall comprising:

a fixed frame providing upright wall portions and a header portion spanning between the upright wall portions; and a plurality of removably attached modules that, when combined, fully fill in the fixed frame of the at least one modular wall between the upright portions and from the header portion to a floor, wherein, when one or more of the plurality of removably attached modules is omitted from within the fixed frame, an opening is provided through the at least one modular wall that is sized and positioned to correspond with at least one of a full-sized doorway, a window, or a threshold through the modular backdrop system, and wherein the plurality of removably attached modules include four different sizes comprising:

at least one first module having a first height H1 and a first width W1;

at least one second module having a second height H2, different from the first height H1, and the at least one second module having a second width W2 approximately equal to the first width W1;

at least one third module having a third height H3 approximately equal to the sum of H1 plus H2, and a third width W3 different from the second width H2; and at least one fourth module having the first height H1 and the third width W3.

2. The modular backdrop system according to claim 1, wherein the at least one modular wall comprises a first modular wall and a second modular wall arranged at approximately a right angle with respect to one another.

3. The modular backdrop system according to claim 1, wherein H3 is equal to a height of the full-sized doorway and W1 is equal to a width of the full-sized doorway.

4. The modular backdrop system according to claim 1, wherein H3 is equal to a height of the full-sized doorway of about 82 inches tall and W1 is equal to a width of the full-sized doorway of about 36 inches wide.

5. The modular backdrop system according to claim 1, wherein the plurality of removably attached modules are configured to allow a width of the opening to be selected in approximate one-foot increments.

6. The modular backdrop system according to claim 1, wherein the plurality of removably modules comprise a set of modules consisting of modules of the four different sizes.

7. The modular backdrop system according to claim 6, wherein the set of modules comprises N first modules and N/2 second modules, wherein N is an even integer.

8. The modular backdrop system according to claim 7, wherein the set of modules comprises M third modules and M fourth modules, wherein M is an integer.

9. The modular backdrop system according to claim 1, wherein the plurality of removably attached modules are connected together by releasable fasteners.

10. The modular backdrop system according to claim 9, wherein the releasable fasteners are not integrated as part of the plurality of removably attached modules.

11. The modular backdrop system according to claim 10, wherein the releasable fasteners are clamps.

12. A modular backdrop system, comprising:

at least one wall, comprising:

a first appearance provided by a set of removably attached modules, the first appearance being substantially continuous from a floor to a top of the at least one wall, and being substantially continuous from a first vertical side to a second vertical side of the at least one wall; and a second appearance provided by omitting at least one of the removably attached modules from the combined set of removably attached modules;

wherein the set of removably attached modules has modules of four different sizes;

wherein the four different sizes comprise:

at least one first module having a first height H1 and a first width W1;

at least one second module having a second height H2, different from the first height H1, and the at least one second module having a second width W2 approximately equal to the first width W1;

at least one third module having a third height H3 approximately equal to the sum of H1 plus H2, and a third width W3 different from the second width H2; and at least one fourth module having the first height H1 and the third width W3.

13. The modular backdrop system according to claim 12, wherein the set of removably attached modules comprises at least one first module having a first width, and at least one second module having a second width different from the first, wherein the at least one second module allows a width of an at least one opening defining the second appearance to be selected in approximate one-foot increments.

14. The modular backdrop system according to claim 12, wherein H3 is equal to the height of a full-sized doorway and W1 is equal to the width of the full-sized doorway.

15. The modular backdrop system according to claim 12, wherein the second appearance comprises at least one of a full-sized doorway of about 82 inches tall by about 36 inches wide, and a full-size window of at least 36 inches wide and at least 64 inches tall.

16. The modular backdrop system according to claim 12, wherein the at least one wall comprises a first wall and a second wall arranged at approximately a right angle with respect to one another, each of the first wall and the second wall comprising:

a fixed frame providing upright wall portions and a header portion spanning between the upright wall portions; and the set of removably attached modules that, when combined, fully fill in the fixed frame of the modular backdrop system between the upright portions and from the header portion to the floor.

17. The modular backdrop system according to claim 16, wherein the first wall includes a first set of modules to fully enclose a first frame and the second wall includes a second set of modules to fully enclose a second frame, wherein the contents of the first set of modules and the second set of modules are different.

18. The modular backdrop system according to claim 12, wherein the set of removably attached modules comprises N first modules and N/2 second modules, wherein N is an even integer.

19. The modular backdrop system according to claim 18, wherein the set of removably attached modules comprises M third modules and M fourth modules, wherein M is an integer.

20. The modular backdrop system according to claim 12, wherein two or more modules of the set of removably attached modules are connected together by releasable fasteners.

21. The modular backdrop system according to claim 20, wherein the releasable fasteners are clamps.

22. A method of creating a backdrop, comprising:

assembling at least one modular wall by removably attaching a plurality of modules to a fixed frame and one another to create a first appearance provided by the plurality of modules, the first appearance being substantially continuous from a floor to a top of the at least one module wall, and being substantially continuous from a first vertical side to a second vertical side of the at least one modular wall, the plurality of modules include four different sizes comprising:

at least one first module having a first height H1 and a first width W1;

at least one second module having a second height H2, different from the first height H1, and the at least one second module having a second width W2 approximately equal to the first width W1;

at least one third module having a third height H3 approximately equal to the sum of H1 plus H2, and a third width W3 different from the second width H2; and at least one fourth module having the first height H1 and the third width W3; and adding at least one of a door frame and a window frame; and creating a second appearance by omitting at least one of the plurality of modules from the assembled at least one modular wall.

23. The method of claim 22, comprising:

covering a face of the assembled at least one modular wall.

24. The method of claim 22, wherein removably attaching comprises joining adjacent modules of the plurality of modules with releasable fasteners.

25. The method of claim 24, wherein the releasable fasteners are separate from the adjacent modules.

* * * * *